US006484849B2

(12) United States Patent
Vecchiotti et al.

(10) Patent No.: US 6,484,849 B2
(45) Date of Patent: Nov. 26, 2002

(54) ELEVATOR SPEED MEASUREMENT SYSTEM INCLUDING REFLECTIVE SIGNAL TECHNOLOGY FOR MAKING SPEED DETERMINATIONS

(75) Inventors: Alberto Vecchiotti, Middletown, CT (US); Michael Flynn, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/795,594

(22) Filed: Feb. 28, 2001

(65) Prior Publication Data

US 2002/0117359 A1 Aug. 29, 2002

(51) Int. Cl.[7] ..... B66B 3/00
(52) U.S. Cl. ..... 187/393; 187/900
(58) Field of Search ..... 187/247, 391, 187/393, 394, 900, 399

(56) References Cited

U.S. PATENT DOCUMENTS 3,203,506 A * 8/1965 Cummins ..... 187/29 R
4,311,212 A * 1/1982 Simpson ..... 187/29 A
4,880,082 A * 11/1989 Kahkipuro et al. ..... 187/393
5,042,621 A * 8/1991 Ovaska et al. ..... 187/133
5,151,562 A * 9/1992 Fujita et al. ..... 187/134
5,306,882 A * 4/1994 Gerwing et al. ..... 187/134
5,393,941 A * 2/1995 Mizuno et al. ..... 187/293
5,889,239 A * 3/1999 Blackaby et al. ..... 187/391
6,079,521 A * 6/2000 Schonauer et al. ..... 187/393
6,128,116 A * 10/2000 Dobler et al. ..... 187/391
6,253,879 B1 * 7/2001 Skalski et al. ..... 187/287

FOREIGN PATENT DOCUMENTS

GB 2211046 A * 10/1987
JP 6-127851 * 5/1994

* cited by examiner

*Primary Examiner*—Jonathan Salata
(74) *Attorney, Agent, or Firm*—Carlson, Gaskey & Olds

(57) ABSTRACT

An elevator speed measurement system includes a reflective sensing device that is supported within the hoistway. In one example, the reflective sensing device is a radar-type device that is supported for movement with the cab through the hoistway. Reflected signals off of a structural component within the hoistway provides information regarding speed of movement of the cab in the hoistway. The speed signals are then transmitted to a remotely located receiver that provides an indication to a technician of the speed of the elevator movement.

24 Claims, 1 Drawing Sheet

ELEVATOR SPEED MEASUREMENT SYSTEM INCLUDING REFLECTIVE SIGNAL TECHNOLOGY FOR MAKING SPEED DETERMINATIONS

BACKGROUND OF THE INVENTION

1. This invention generally relates to elevator systems. More particularly, this invention relates to a system for measuring elevator speed within a hoistway.

2. At various times it becomes necessary to measure the speed of an elevator cab moving through a hoistway. One particular need is during elevator installation or adjustment. Conventionally, an elevator technician or mechanic climbs on top of the cab and utilizes a hand-held tachometer to check the speed of the elevator during adjustment or testing. This technique typically requires the technician to hold the tachometer against one of the guide rails within the hoistway while simultaneously attempting to run the elevator using the top of car inspection box. While this technique does provide speed information, there are shortcomings.

3. Efficiency and accuracy of the measurement are sometimes compromised because of the technician's capabilities for maintaining contact between the tachometer and the guide rail with one hand while operating the top of car inspection box with the other hand. Additionally, there are safety concerns any time that a technician is required to be on top of an elevator cab while it is moving through the hoistway.

4. This invention provides a significant improvement in the field of measuring elevator speeds. With this invention, the technician is no longer required to be on top of the elevator cab during movement.

SUMMARY OF THE INVENTION

5. In general terms, this invention is a system for measuring the speed of an elevator cab moving within a hoistway. A system designed according to this invention includes a reflective device that utilizes signal reflections from a structure within the hoistway and provides a signal that is indicative of a speed of the elevator cab. A transmitter associated with the reflective device transmits a signal indicative of the speed. A remotely located receiver receives the transmitted signal and provides an output indicative of the cab speed.

6. In the preferred embodiment, the reflective device is mounted onto the elevator cab and the speed-measuring signals are reflected from a guide rail in the hoistway. The currently preferred embodiment of the remotely located receiver is a handheld device that provides a visual display to a technician for analyzing the speed information.

7. The various features and advantages of this invention will become apparent to those skilled in the art from the following detailed description of the currently preferred embodiments. The drawing that accompanies the detailed description can be briefly described as follows.

BRIEF DESCRIPTION OF THE DRAWING

8. The FIGURE diagrammatically illustrates an elevator speed measurement system designed according to this invention.

DETAILED DESCRIPTION OF THE PREFERRED EMBODIMENTS

Figure 1:
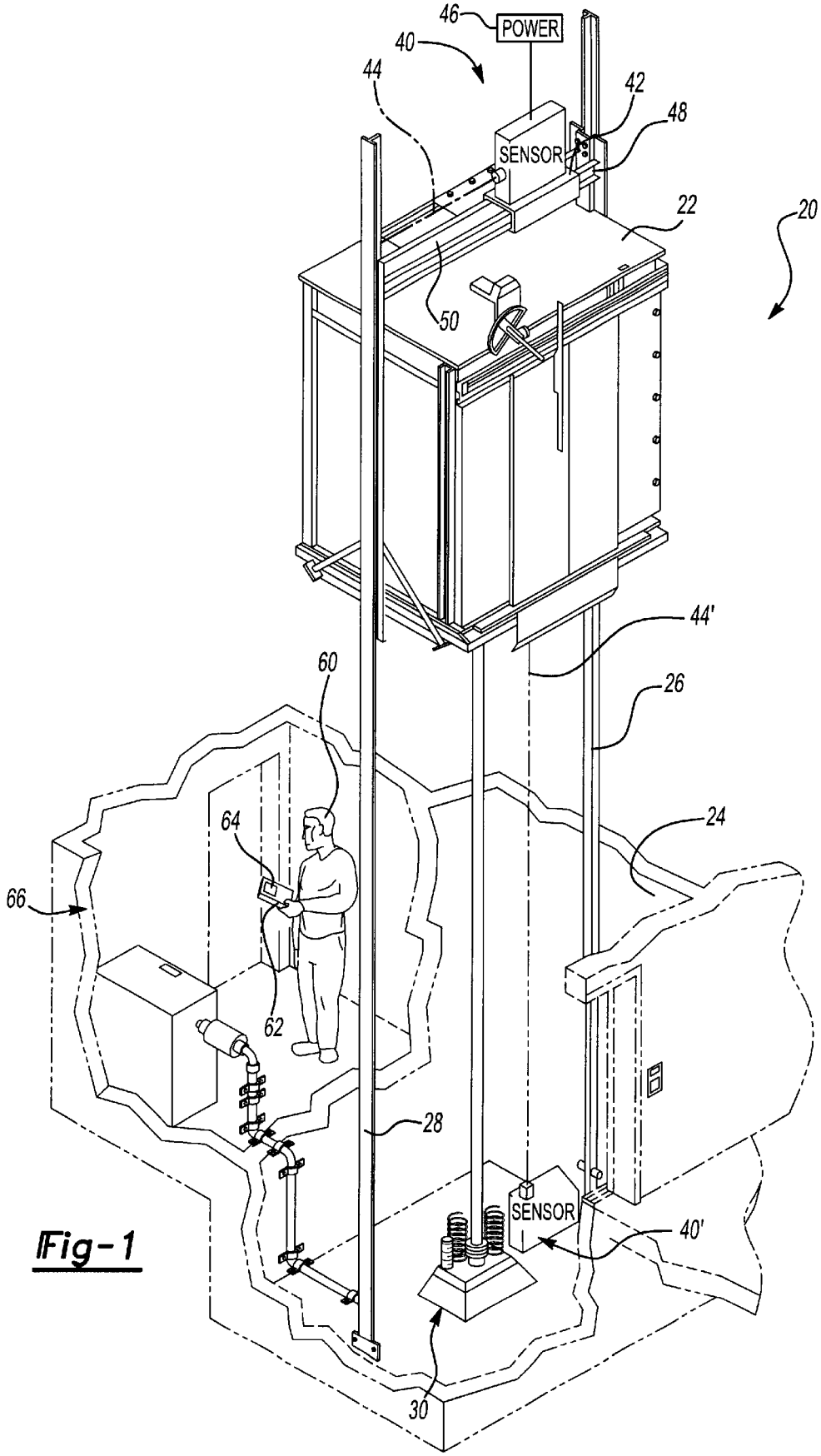

9. An elevator system 20 includes an elevator cab 22 that moves within a hoistway 24 in a conventional manner.

Guide rails 26 and 28 guide the cab 22 along its path of travel in the hoistway 24 between various landings of a building as is known in the art.

10. The illustrated embodiment is a hydraulic elevator having a hydraulic mover mechanism 30, which serves to move the cab between the various landings and the hoistway 24. Of course, this invention is not limited to hydraulic elevators. There is particular use for this invention in a hydraulic elevator arrangement because there typically is a need for a technician to monitor elevator speed and adjust the hydraulic valve settings so that actual elevator speed is consistent with the desired speeds at the particular location.

11. The measuring device 40 designed according to this invention preferably includes a reflective sensor portion 42 that emits a signal that is reflected from a structural component within the hoistway 24. In the illustrated example, the reflective sensing device 42 emits a signal 44 that is reflected off of the guide rail 28. As the elevator cab 22 moves through the hoistway 24, information from the reflected signal 44 provides an indication of the speed of the cab.

12. In one example, the reflective sensing device is a radar sensor. In another example, a laser reflective device is utilized. Such devices and the manner in which reflective signals are processed by such devices to provide speed information are known.

13. In the preferred embodiment, the reflective device 40 preferably includes a self-contained power unit 46 for providing power to the reflective device within the hoistway. In one example, a mounting element 48 facilitates mounting the reflective sensor to the cab crosshead 50 so that it can be conveniently placed when the need for speed measurement occurs. The mounting element 48 preferably is a removable bracket that facilitates easily mounting or removing the reflective device 40.

14. In another example, a reflective sensing device 40' is positioned within the hoistway to receive reflective signals 44' from the cab as the cab moves through the hoistway, thereby providing speed information. Whether the reflective device is supported for movement with the elevator cab in the hoistway or positioned in a single location within the hoistway depends upon the needs or configuration of a particular situation. Given this description, those skilled in the art will be able to choose which of the sensor mounting arrangements best suits their particular needs.

15. A technician 60 obtains speed information from the sensor device 40 through an interface 62. In the illustrated example, the interface 62 is a handheld device that is carried about by the technician 60. A conventional display screens 64 provides information to the technician 60 in a convenient location such as the machine room 66. In this way, the technician can more easily adjust the system as needed to achieve the desired speed operation.

16. The preferred embodiment includes wireless communication between the sensing device 40 and the interface device 62 so that the technician can be at any convenient location while obtaining the speed information.

17. In one example, the operator interface 62 includes computing capabilities that utilizes the speed information gathered by the sensor to determine acceleration information regarding movement of the cab 22. Additionally, the interface 62 preferably includes storage for maintaining information regarding a speed profile of the elevator cab that is appropriately displayed on the display screen 64 when desired. Additionally, the interface 62 can be programmed to have a digital input that stops speed acquisition when the input reaches a selected threshold. In this manner, the inventive device serves as a trigger to accurately measure events such as tripping a governor.

18. This invention is particularly useful for elevator installation and maintenance procedures. Given this description, those skilled in the art will be able to appropriately select the electronics and other components and to appropriately program them to accomplish the results provided by this invention.

19. A speed measurement device and system designed according to this invention provides significant advantages to prior arrangements. The time needed to perform an accurate speed adjustment is reduced by approximately 50% when using a device designed according to this invention. Moreover, there are significant operator efficiency and safety improvements utilizing a device designed according to this invention.

20. The preceding description is exemplary rather than limiting in nature. Variations and modifications to the disclosed examples may become apparent to those skilled in the art that do not necessarily depart from the purview and spirit of this invention. The scope of legal protection given to this invention can only be determined by studying the following claims.

What is claimed is:

1. A device for determining a speed of movement of an elevator cab within a hoistway, comprising:

a reflective device that utilizes signal reflections from a structure within the hoistway and provides a signal that is indicative of a speed of the elevator cab;

a transmitter associated with the reflective device that transmits a signal indicative of the speed; and a remotely located receiver that comprises a handheld device having a display screen that provides a visual indication indicative of the speed, wherein the receiver receives the transmitted signal and provides an output indicative of the cab speed.

2. The device of claim 1, wherein the reflective device includes a radar emitter portion and a radar receiver portion.

3. The device of claim 1, wherein the reflective device includes a laser emitter portion and a reflected laser receiver portion.

4. The device of claim 1, wherein the transmitter and the receiver communicate using wireless communication.

5. An elevator system comprising:

a cab adapted to carry passengers;

at least one structural member that remains fixed and is associated with supporting the cab for movement in a hoistway;

a reflective sensing device that utilizes signal reflections from the structural member and provides a signal that is indicative of a speed of the cab moving in the hoistway;

a transmitter associated with the reflective sensing device that transmits a signal indicative of the speed; and a remotely located receiver that receives the transmitted signal and provides an output indicative of the cab speed.

6. The system of claim 5, wherein the reflective sensing device is supported on the cab.

7. The system of claim 6, including a removable bracket for removably supporting the reflective sensing device on the cab.

8. The system of claim 5, wherein the reflective sensing device includes a radar emitter portion and a radar receiver portion.

9. The system of claim 5, wherein the reflective sensing device includes a laser emitter portion and a reflected laser receiver portion.

10. The system of claim 5, wherein the remotely located receiver comprises a handheld device having a display screen that provides a visual indication indicative of the speed.

11. The system of claim 5, wherein the transmitter and the receiver communicate using wireless communication.

12. A method of measuring a speed of movement of an elevator cab within a hoistway, comprising the steps of:

supporting a reflective signaling device relative to the elevator cab;

emitting a signal from the signaling device toward a structural member that remains fixed within the hoistway and is associated with supporting the cab for movement in the hoistway;

receiving a reflected signal that reflects from the structural member;

determining the speed of movement using the reflected signal, and providing an output indicative of the speed.

13. The method of claim 12, including supporting the reflective signaling device on the elevator cab and receiving the reflected signal from a reflection from a structural member within the hoistway.

14. The method of claim 13, including removing the reflective signaling device from the cab after determining the speed.

15. The device of claim 1, including a bracket for supporting the reflective device on an elevator cab, the bracket being selectively removable so that the reflective device is selectively placed on or removed from the elevator cab.

16. The system of claim 5, wherein the structural member comprises a guide rail that is operative to guide the cab in the hoistway.

17. The method of claim 12, wherein the structural member comprises a guide rail that is operative to guide the cab in the hoistway.

18. A device for determining a speed of movement of an elevator cab within a hoistway, comprising:

a reflective device that includes a radar emitter portion and a radar receiver portion that utilizes radar signal reflections from a structure within the hoistway and provides a signal that is indicative of a speed of the elevator cab;

a transmitter associated with the reflective device that transmits a signal indicative of the speed; and a remotely located receiver that receives the transmitted signal and provides an output indicative of the cab speed.

19. The device of claim 18, wherein the remotely located receiver comprises a handheld device having a display screen that provides a visual indication indicative of the speed.

20. The device of claim 18, including a support bracket that is selectively placed upon or removed from an elevator cab so that the reflective device is temporarily selectively supported on or removed from the elevator cab.

21. An elevator system comprising:

a cab adapted to carry passengers;

at least one structural member that is associated with the cab in a hoistway;

a reflective sensing device that utilizes signal reflections from the structural member and provides a signal that is indicative of a speed of the cab moving in the hoistway;

a removable bracket for temporarily and removably supporting the reflecting sensing device on the cab;

a transmitter associated with the reflective sensing device that transits a signal indicative of the speed; and a remotely located receiver that receives the transmitted signal and provides an output indicative of the cab speed.

22. The system of claim 21, wherein the remotely located receiver comprises a handheld device having a display screen that provides a visual indication indicative of the speed.

23. The system of claim 22, wherein the handheld device receives the signal from the transmitter using wireless communication.

24. A method of measuring a speed of movement of an elevator cab within a hoistway, comprising the steps of:

supporting a reflective signaling device relative to the elevator cab;

emitting a signal from the signaling device toward a structural member within the hoistway;

receiving a reflective signal that reflects from the structural member;

determining the speed of movement using the reflected signal;

providing an output indicative of the speed; and removing the reflective signaling device from the cab after determining the speed.

* * * * *